United States Patent [19]

Kato et al.

[11] Patent Number: 4,768,450

[45] Date of Patent: Sep. 6, 1988

[54] INITIAL OPERATION CONTROLLING SYSTEM FOR A COMPUTER CONTROLLED EMBROIDERING MACHINE

[75] Inventors: Kenji Kato, Tokyo; Yoshitaka Takahashi, Kanagawa, both of Japan

[73] Assignee: Janome Sewing Machine Co. Ltds., Tokyo, Japan

[21] Appl. No.: 15,273

[22] Filed: Feb. 17, 1987

[30] Foreign Application Priority Data

Feb. 20, 1986 [JP] Japan ..... 61-33791

[51] Int. Cl.[4] ..... D05B 21/00

[52] U.S. Cl. ..... 112/121.12

[58] Field of Search ..... 112/103, 121.12, 102, 112/121.11, 275, 277, 221, 456, 453, 458

[56] References Cited

U.S. PATENT DOCUMENTS

| | | | |
|---|---|---|---|
| 4,383,489 | 5/1983 | Sugiyama et al. | 112/103 |
| 4,506,612 | 3/1985 | Yanagi | 112/121.12 |
| 4,582,006 | 4/1986 | Yamane | 112/121.12 |
| 4,665,846 | 5/1987 | Takano et al. | 112/121.12 |
| 4,665,847 | 5/1987 | Takano et al. | 112/121.12 |

*Primary Examiner*—Peter Nerbun

*Attorney, Agent, or Firm*—Michael J. Striker

[57] ABSTRACT

By a first operation of a key, an embroidering scope is checked, and by a second operation thereof, an embroidering operation is started, irrespectively of designation of initial stitching.

2 Claims, 16 Drawing Sheets

| Lead number | T number | Contents |
|---|---|---|
| 0.1 | 0~38 | Pattern data |
| 0 | 39 | Pattern control (side, truck and sector number of data blocks corresponding to the pattern numbers) |
| 1 | 39 | Pattern indication data, enlarging and reducing rate data, and pattern data |
| 0.1 | 40~79 | Pattern data |

INITIAL OPERATION CONTROLLING SYSTEM FOR A COMPUTER CONTROLLED EMBROIDERING MACHINE

BACKGROUND OF THE INVENTION

This invention relates to an initial operation controlling system for an embroidering machine.

With respect to centering, initial stitching and starting of the embroidering machine, this kind of operations in the prior art machines has been a a complex process requiring difficult manipulations on part of the operator. A machine operator was frequently required to manipulate various keys in response to instructions sequentially presented by the machine. This dialogue-type operation resulted in a long waiting time for an initial actuation of the embroidering machine.

SUMMARY OF THE INVENTION

An embroidering machine according to the present invention has a single start key and an initial stitching key which designates a starting point of an embroidering stitching. A first operation of a start key moves an embroidering frame without moving a needle vertically in order that the machine operator may check an embroidering scope for the embroidering frame. A second operation of the start key moves the frame to a stitching position designated by the initial stitching key. If this designation is not made, the frame is moved to the centering position to start stitching whereby the centering position serves as a standard stitch starting position.

DETAILED DESCRIPTION OF PREFERRED EMBODIMENTS OF THE INVENTION

Embodiments of the invention will be explained with reference to the attached drawings.

Figure 2:
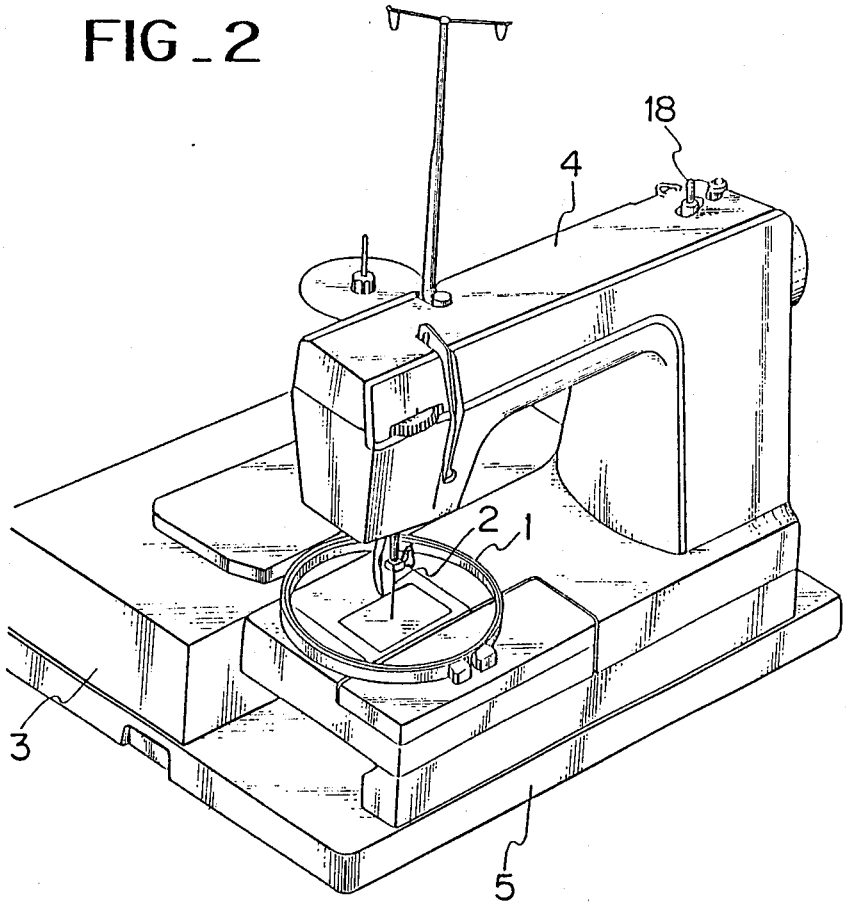
FIG. 2 is a perspective view of an embroidering machine for the invention.

In FIG. 2, a reference numeral 1 designates an embroidering frame which holds an object or fabric to be embroidered and is positioned for a needle 2 vertically moving within its boundary. A numeral 3 designates a driving mechanism along X-Y coordinate axes for effecting X-Y control of said embroidering frame 1.

A part which penetrates an embroidering thread into the object, is composed of the needle 2 and a loop taker device (not shown). A machine body 4 belongs to a straight stitching sewing machine, but does not need a fabric feed dog nor a fabric presser which are incorporated in ordinary sewing machines. The machine body 4 and the X-Y axis driving mechanism 3 are fixed to a machine bed 5 by bolts.

Within the X-Y driving mechanism 1, there are housed a stepping motor for driving X shaft, a stepping motor for driving Y shaft, a power source switch, a power source transformer, a power source circuit, driving circuits for said stepping motors, and other components known from prior art.

Figure 3:
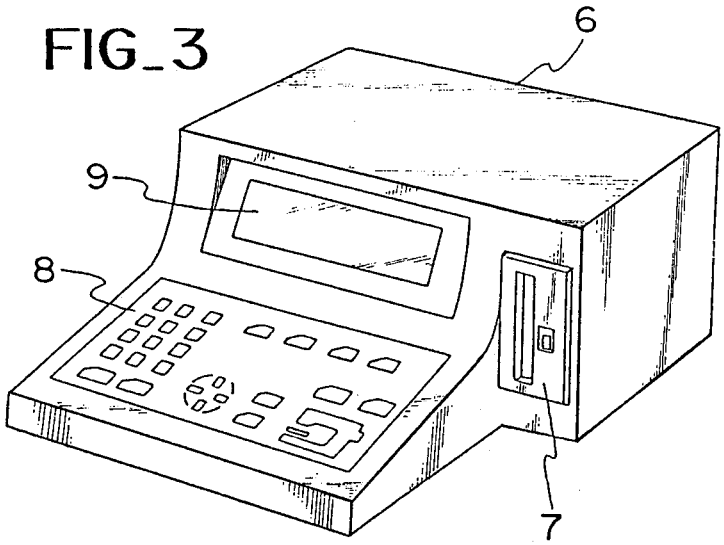
FIG. 3 is a perspective view of a control box according to the invention.

In FIG. 3, the numeral 6 designates a control box which controls all actuations of the machine body 4, and has a floppy disc drive part 7, a key panel part 8 and LCD display part 9, and incorporated therein are electronic control circuits which will be explained later on.

The power source of the electronic control circuits is extended from the power source circuits of said X-Y control mechanisms, and receive signals from the machine body 4 via connecting cables. The embroidering pattern data are written into a ordinary floppy disc when preparing initial data, and when the machine operator inserts the disc into the floppy disc drive part 7, necessary data are read out.

Figure 1:
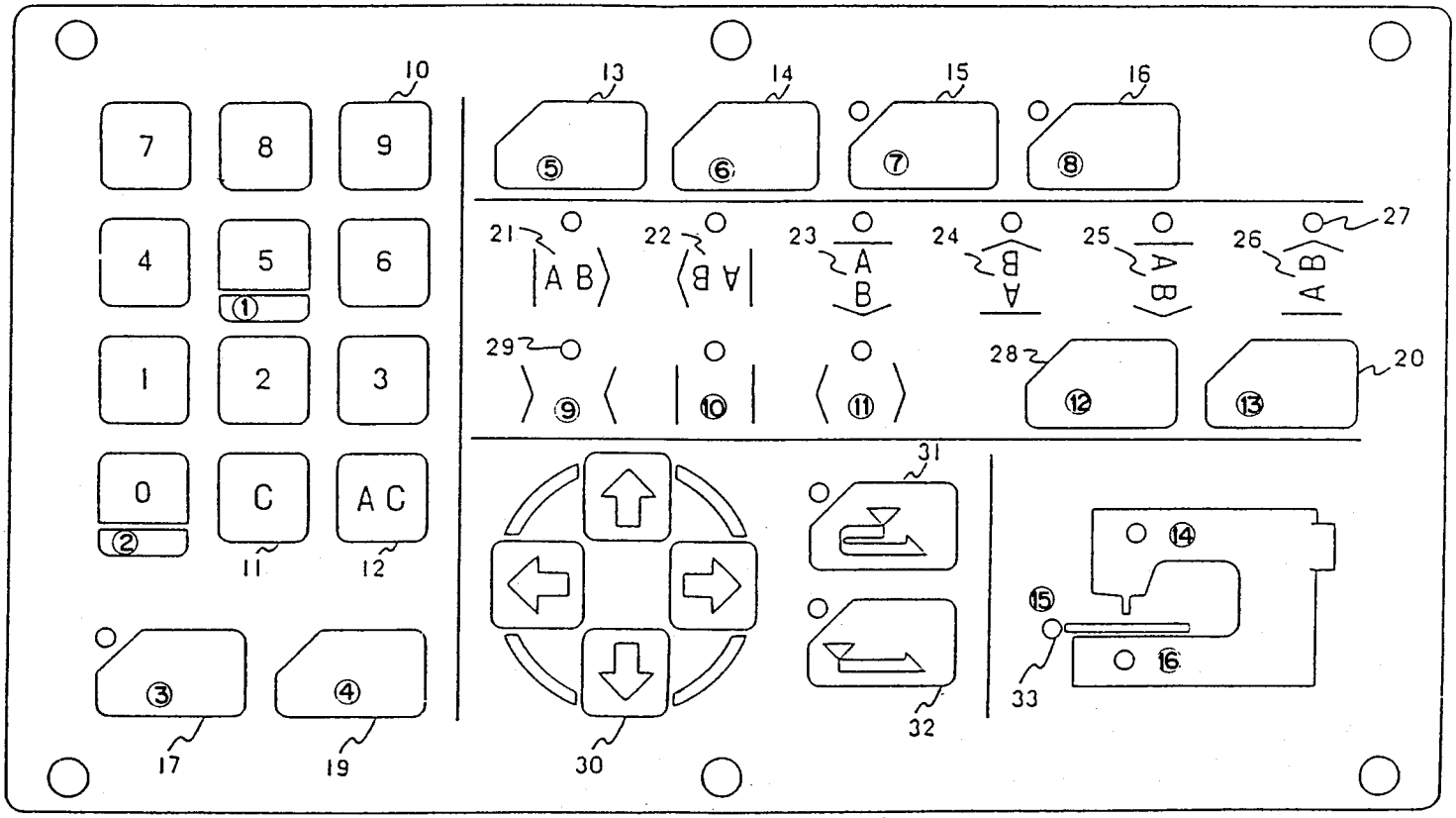
FIG. 1 is a plan view of a key panel part of a control box for an embroidering machine showing an embodiment of the invention.

FIG. 1 shows the key panel part 8. Figure keys 10 are used for selecting a number of a letter or for manual setting of a space. A clear key 11 is used for clearing an erroneous input or for returning to a stitching starting point during stopping in the course of stitching. When an all clear key 12 is pushed, the selected numbers which have been registered and stored by the figure keys 10, a registration key 13, and a registration-finish key 14, are all automatically cleared or returned to the original point of the frame.

When "0" of the figure keys 10 is pushed during stopping in the course of stitching, the embroidering frame is retreated, and when "5" is pushed, the frame is advanced.

When a letter number is selected and the registration key 13 is pushed, said letter number is registered. The registration finish key 14 is pushed after all numbers of the letters to be embroidered have been registered, so that the desired letter embroidering data, the letter designating data, the letter enlarging or reducing rate data and other controlling data are read out from the floppy disc.

A space key 15 is a manual space key, and this is used when a space between the letters is set at an optional value differing from fixed standard data. The space is determined by a figure key 10, and when the space key 15 is pushed, it is the manual space key. This mode is continued until the all-clear key 12 is pushed A thread winding key 16 is used for winding a lower thread on a bobbin, and when it is pushed, a thread winding mode is initiated. When a start key 17 is pushed, an upper shaft only is rotated while the embroidering frame is not moved. The lower thread may be thus wound on the bobbin mounted on a thread winding shaft 18. The rotation speed of the upper shaft during the thread winding mode can be controlled by pushing "1" to "5" of the figure keys 10. When the stop key 19 is pushed, the upper shaft is stopped and concurrently the thread winding mode is released.

A letter arranging key 20 is to select directions and arrangements of the letters to be embroidered. The directional arrangements are exemplified with "A" and "B" from 21 to 26 as shown. If the key 20 is repeatedly pushed, LED 27 for showing the directional arrangement is lighted in succession, and the pushing is stopped at a lighted desired one of the arrangements, and then when the pushing is stopped the corresponding code of the arranging condition is registered. This function changes the coordinate from 0° to 270° per each 90°, and the coordinate is not changed at optional angles therebetween. Therefore, if only the angle code is registered, the coordinate may be changed per each of stitchings just before starting the stitching by the fixed program.

When the power source is applied, the directional arrangement 21, which is most frequently used, is automatically set.

A letter sizing key 28 changes the sizes of letters to be stitched, and if this operation is repeated, any one of enlargement, standardization and reduction may be selected, and the selected one is indicated by LED 29. Depending upon the kinds of individual letters, they are or are not suitable for the enlargement, standardization and reduction, and in order to increase reliability, the data of the enlarging rate and reducing rate are furnished with respect to the data of each of the letters stored in the floppy disc.

A feed direction designating key 30 moves the embroidering frame 1 to a desired position as shown with an arrow. A centering key 31 arranges letters to be stitched around the present position of the needle when a plurality of letters are embroidered. An initial stitching key 32 starts the stitching from the present position of the needle.

The centering condition is automatically set when the power source is applied. Therefore, the centering operation is not required. When the stitching is started by the centering key 31, the initial stitching key 32 is pushed. For returning from the initial stitching condition to the centering stitching, the centering key 31 is pushed.

If a start key 17 is pushed after the number of a desired letter has been registered or a registration thereof has been finished, the start key 17 moves it to a stitching condition. By the first pushing of the start key 17, the embroidering frame 1 only is moved along a square set for the end point of the needle 2 to designate contours of the embroidering scopes of all the selected letters to be stitched. In such a manner it is possible to confirm whether or not the embroidering scope to be stitched is positioned within the embroidering frame 1. If the stop key 19 is pushed during the above mentioned movement, the stitching is returned to an initial stitching point. At this initial stitching point, the feed direction designating key 30 is pushed so as to move the initial stitching point, and if the start key 17 is pushed again, this changed point will become an initial stitching point, so that the frame is moved to designate the contour of the same embroidering scope. After the moving scope of the frame 1 has been confirmed and when the centering mode is made by the second pushing of the start key 17, the embroidering stitching is started at said centering mode after the centering. At the initial stitching mode, the embroidering stitching is started at the initial stitching point.

The stop key 19 is used for stopping the operation of the sewing machine. Re-start from the stop is made by the start key 17. When the frame is moved to show the aforementioned embroidering scope, and if this condition exceeds the moving limit of X-Y mechanism, the frame is not moved and a warning is issued to show said exceeding condition.

When the frame is moved in a square to show said embroidering scope, the movement is temporalily stopped at any of the right angles in order to secure the confirmation. The conversion from the letter reducing data to the enlargement and the reduction of the final embroidering data, is carried out within a temporary stopping time. This feature is desirable because converting time of all individual embroidering letters is comparatively long and if the conversion is done at once, the machine operator would feel unnecessary discomfort in waiting therefor.

In the invention, the conversion is dividedly done not only with respect to moving of the frame but also during stitching in order to prepare subsequent stitching data. Since the conversion time is changed by the stitching data, the conversion is self-controlled in response to the rotation speed of the sewing machine. Therefore, when the rotation speed is slow, more conversion is possible to heighten the stitching efficiency.

A reason why the rotation speed is changed by the stitching information, is that when the relative movement of the embroidering frame 1 is large due to the stitching information, the driving time of the stepping motor for driving X-Y shaft is long as much, and therefore if the rotation speed of the sewing machine were not delayed, the needle 2 would contact the fabric during moving the frame 1.

The numeral 33 designates an indication part displaying by means of a LED abnormal conditions such as breaking of the upper thread, a small amount of the remaining lower thread and a limiting condition of a moving mechanism of the embroidering frame at the respective parts.

Figure 4:
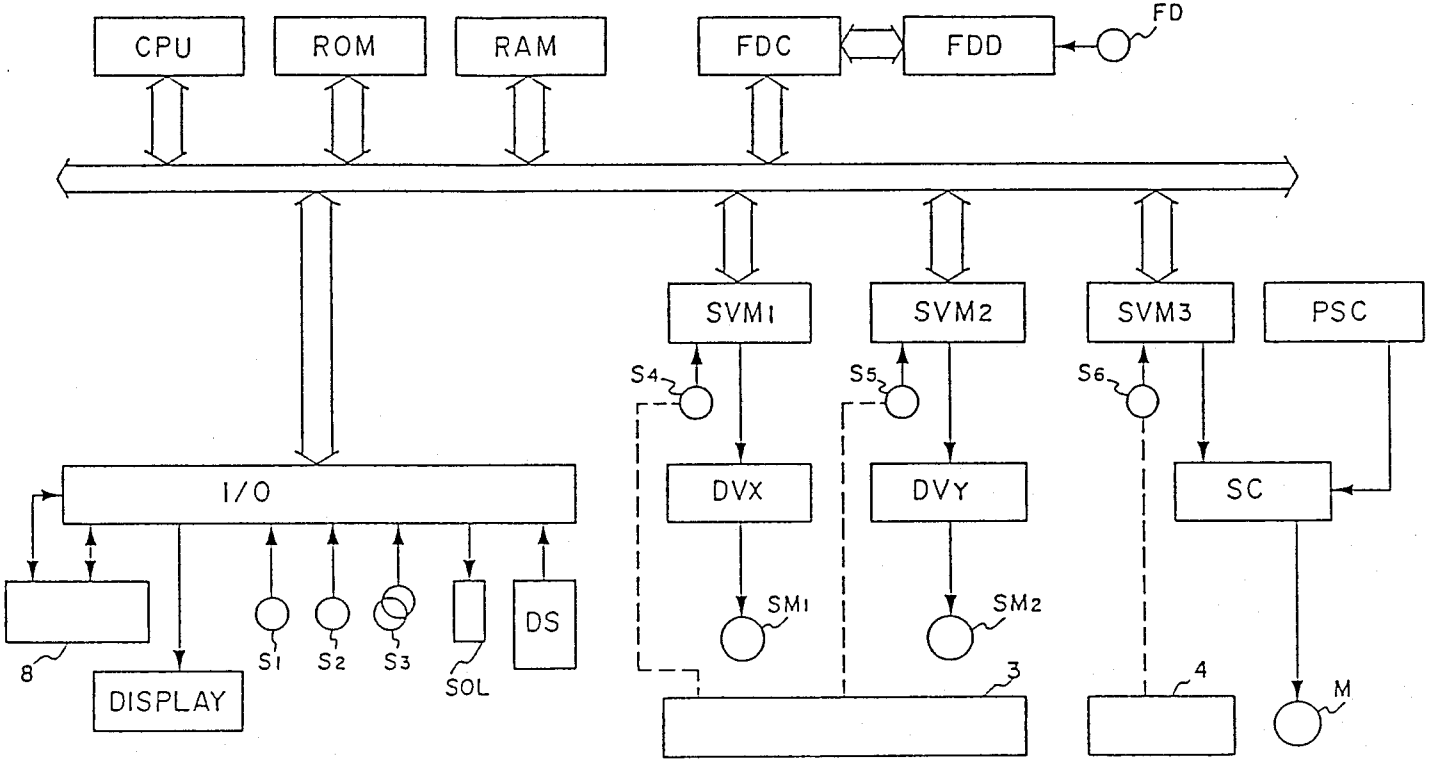
FIG. 4 is a block diagram of a control circuit.

A further explanation will be made to the block diagram of the control circuit shown in FIG. 4.

CPU denotes a micro processor. ROM is a read-only memory. RAM is a radom-access-memory. I/O is an input-output interface available for the program and receives or sends the data between respective devices and the micro processor CPU. CPU, ROM, RAM and I/O compose a main micro computer of the present system.

Figure 5:
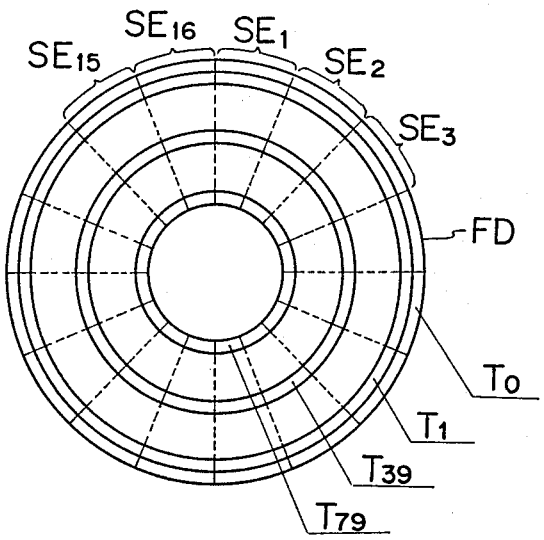
FIG. 5 is an explanatory view of a floppy disc for the circuit of FIG. 4.
Figure 6A:
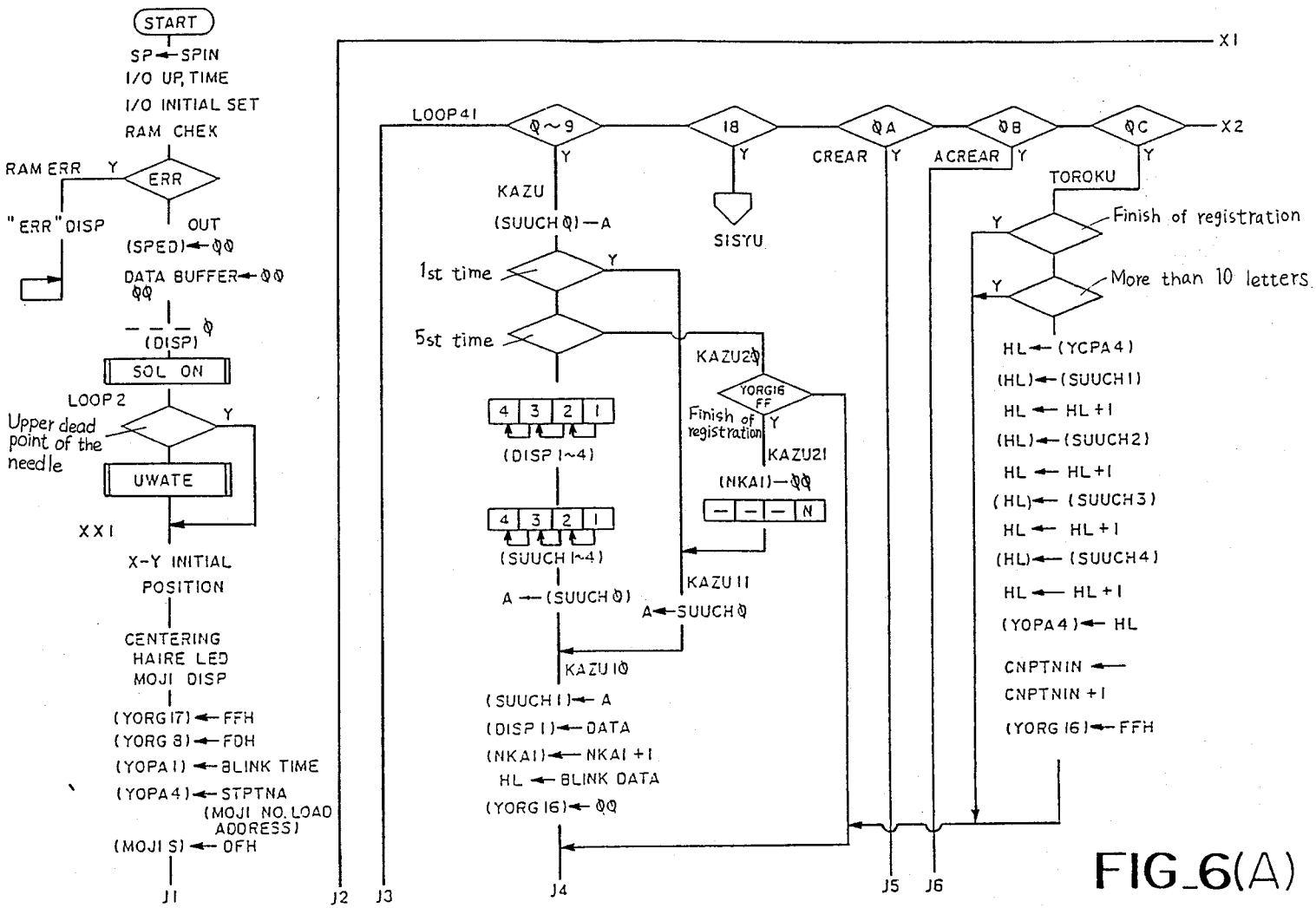
FIGS. 6(A) and (B), FIG. 7, FIGS. 8(A) and (B), and FIG. 9 are flow charts for realizing functions and actuations of the embroidering machine of the invention.
Figure 6B:
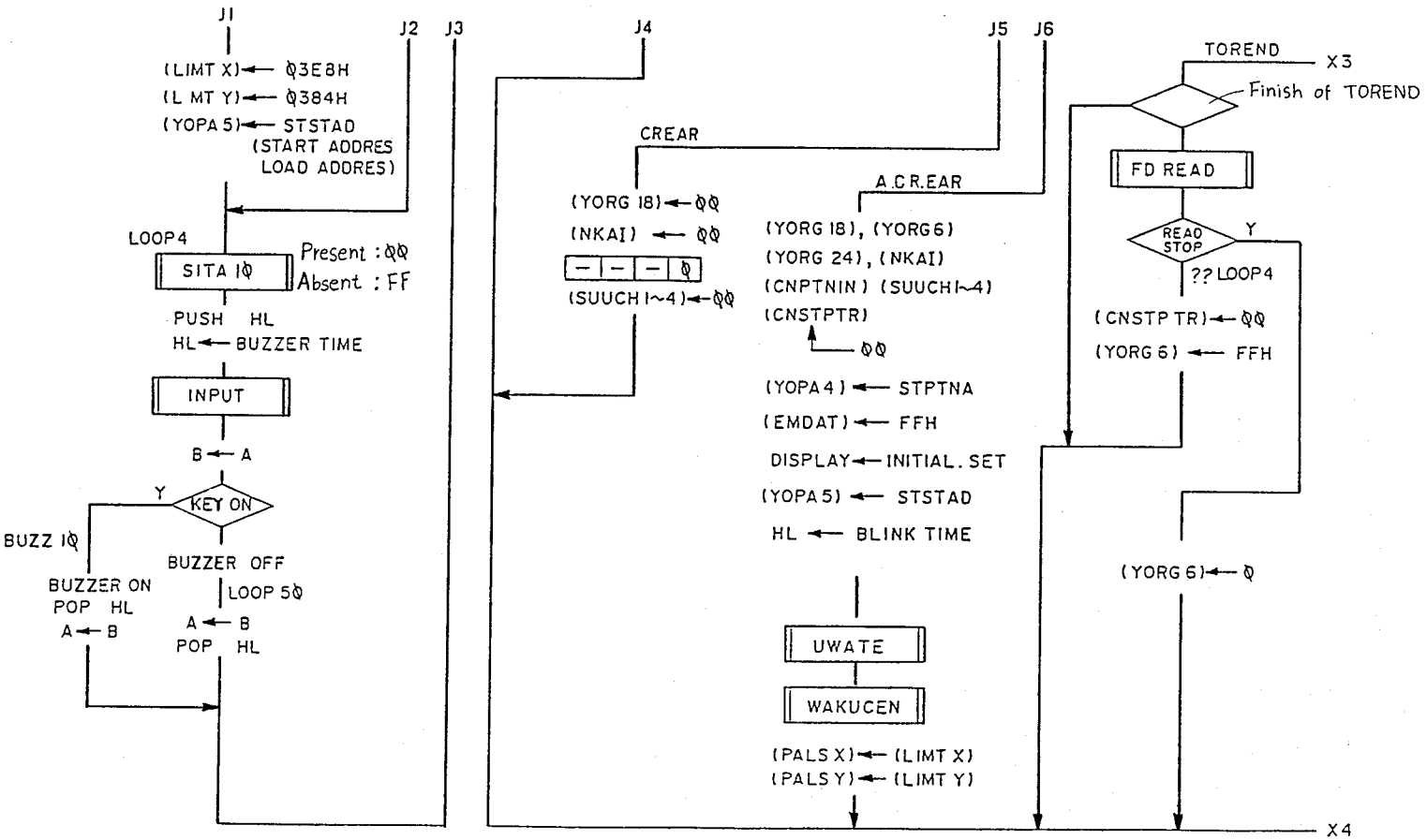
Figure 6C:
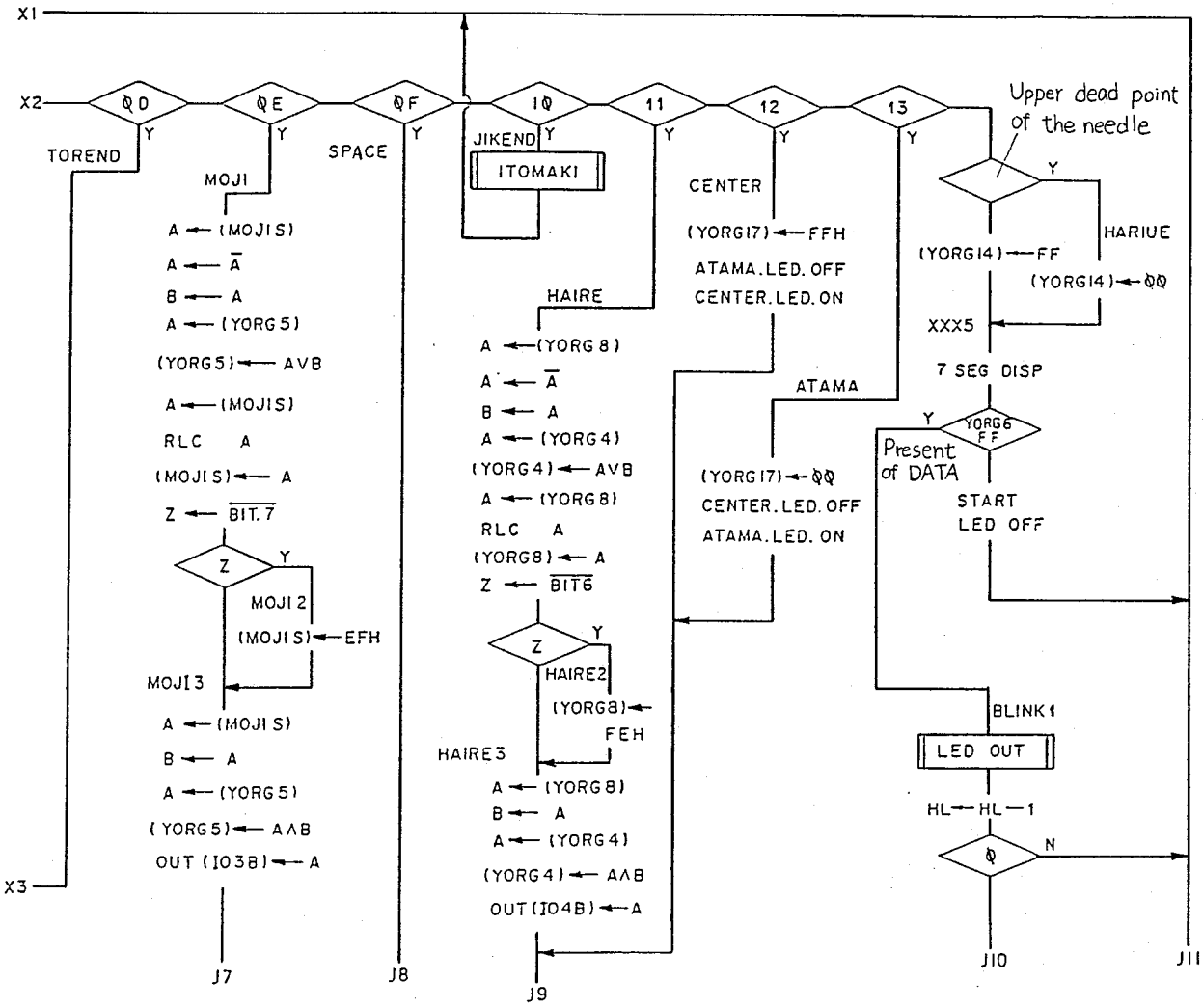
Figure 6D:
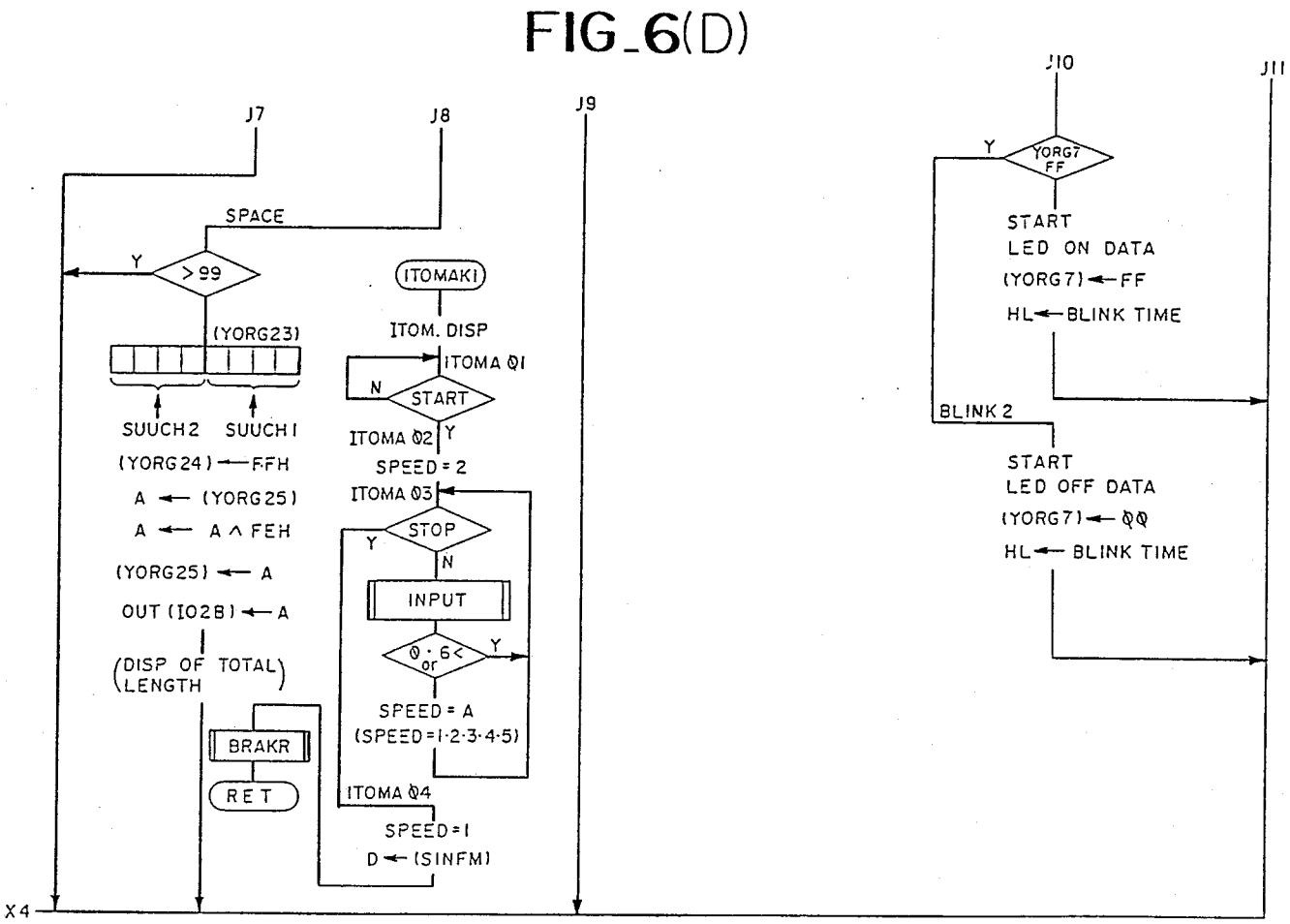
Figure 7A:
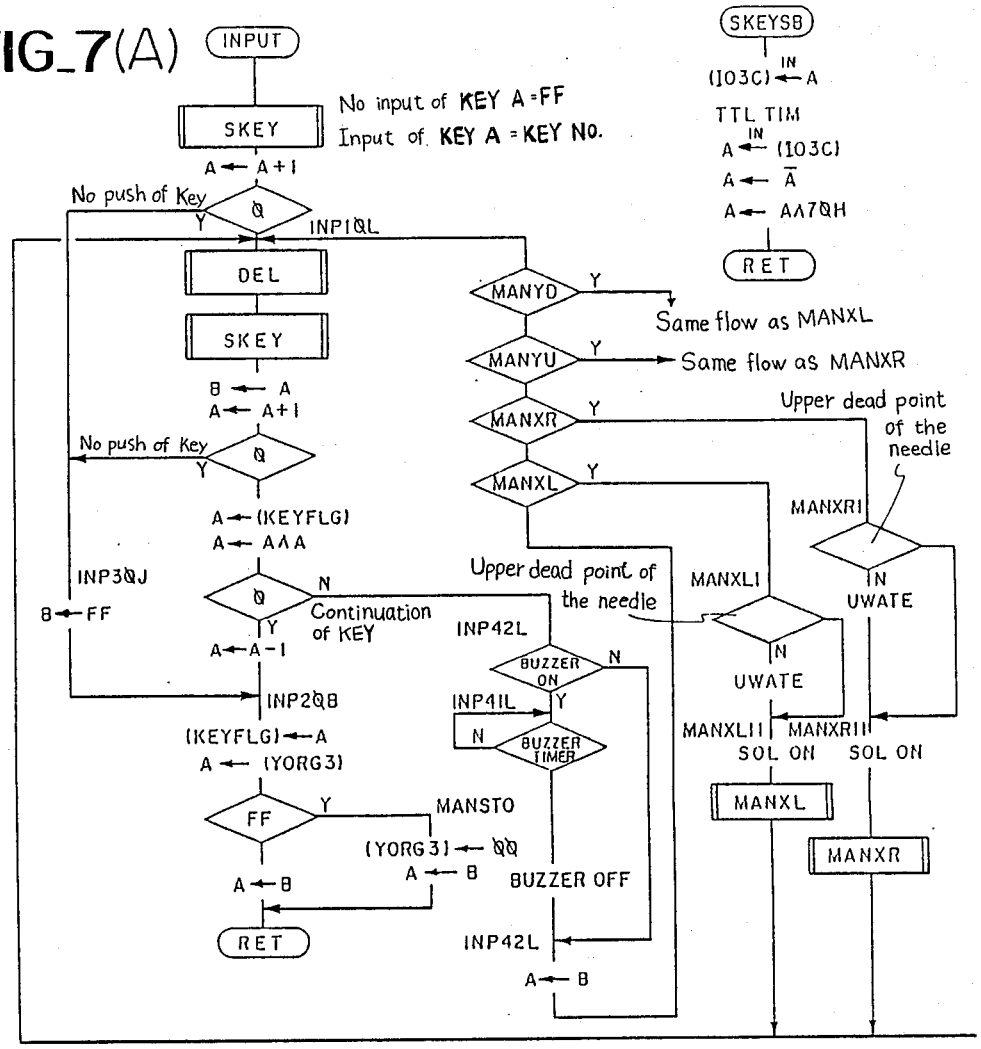
Figure 7A:
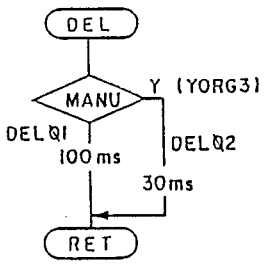
Figure 7A:
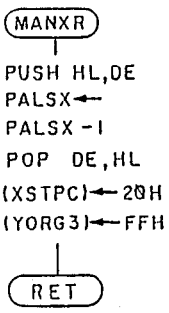
Figure 7A:
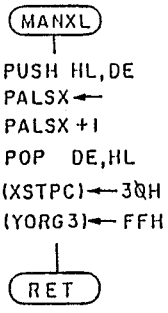
Figure 7B:
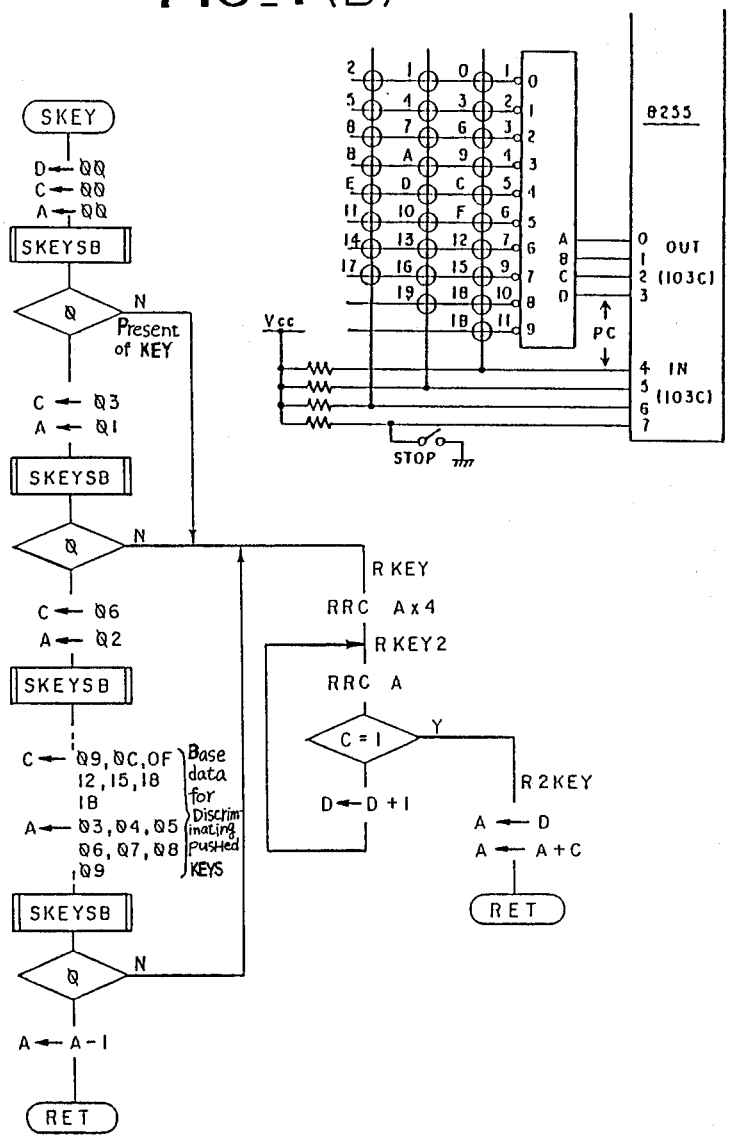
Figure 8A:
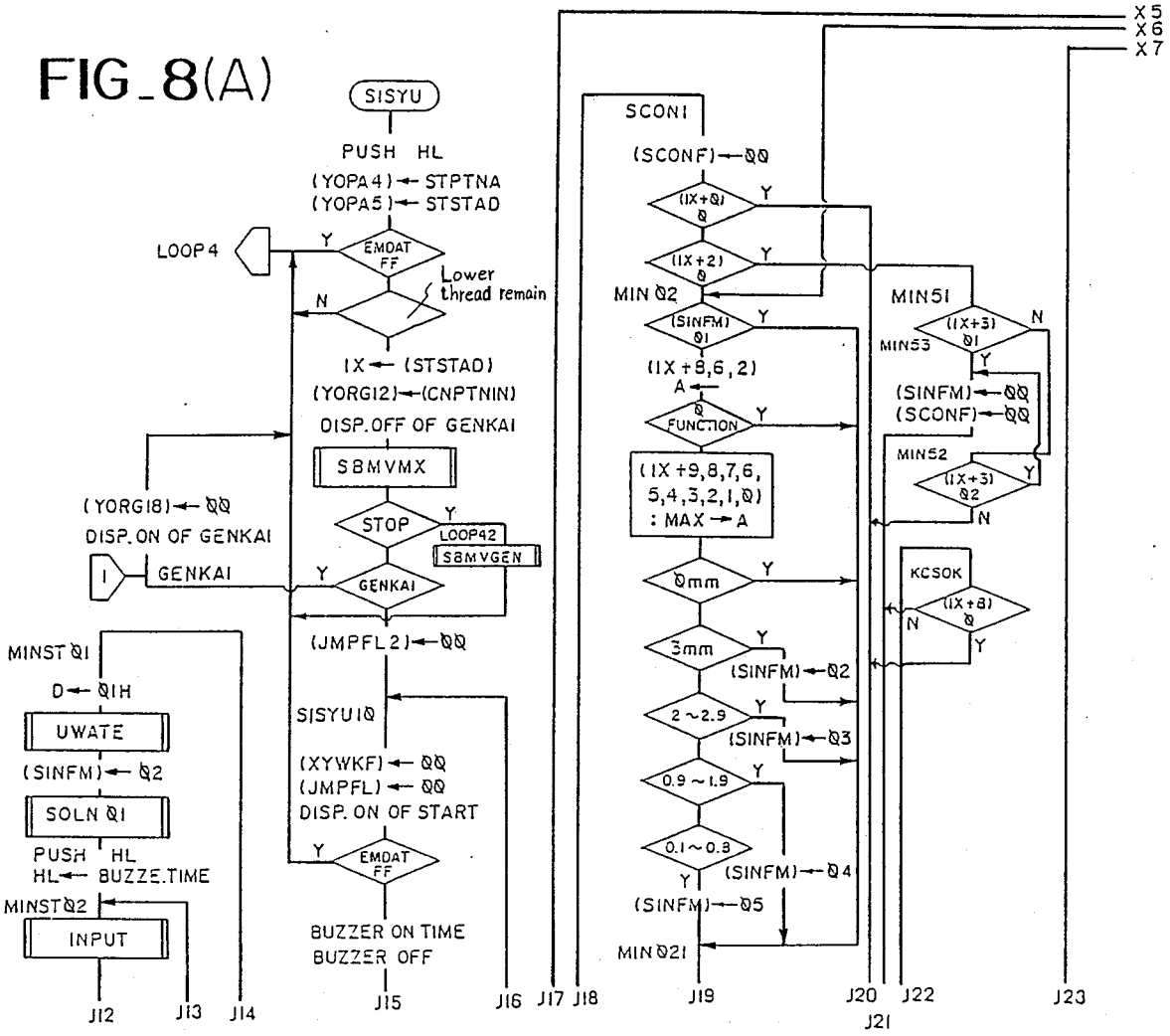
Figure 8B:
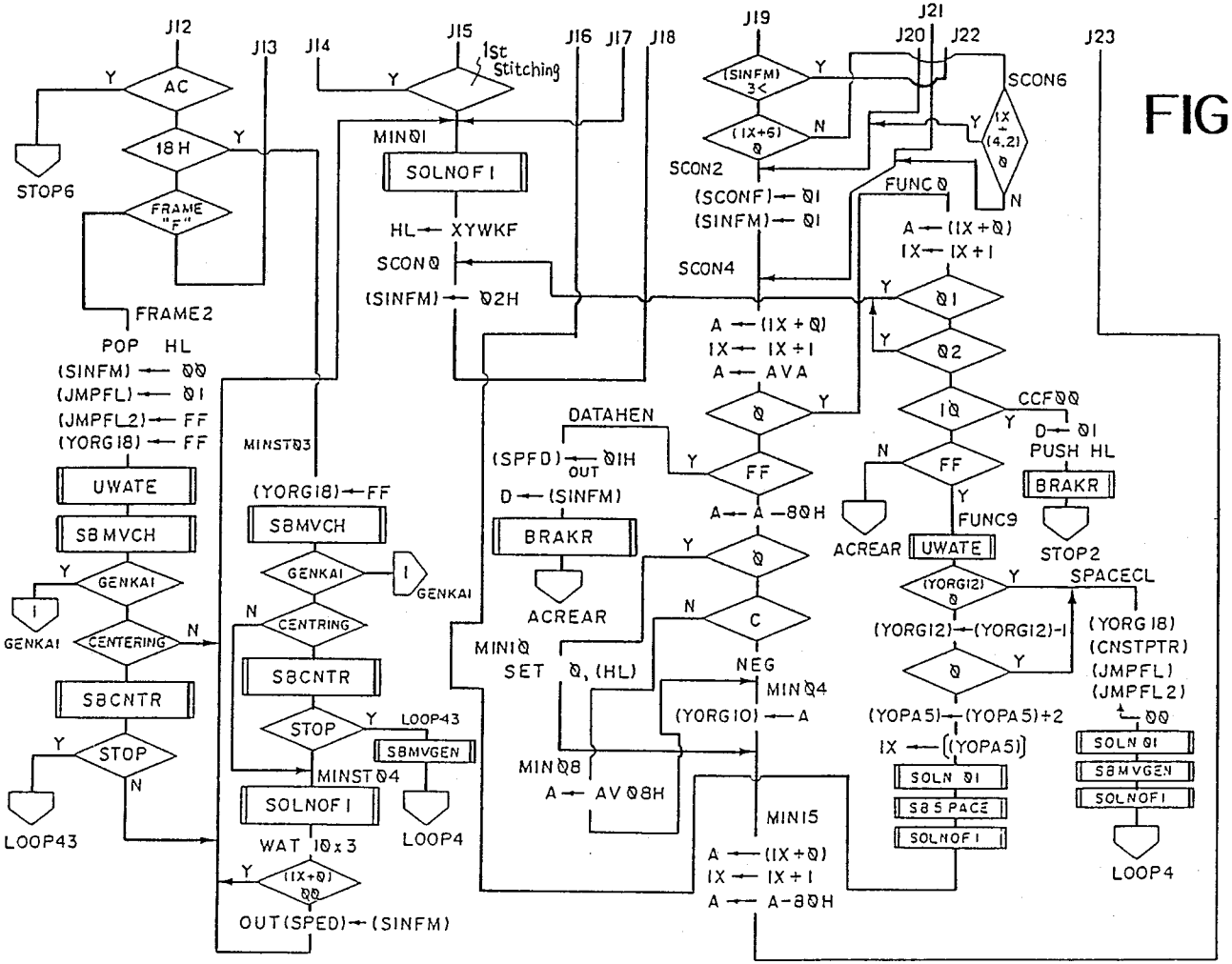
Figure 8C:
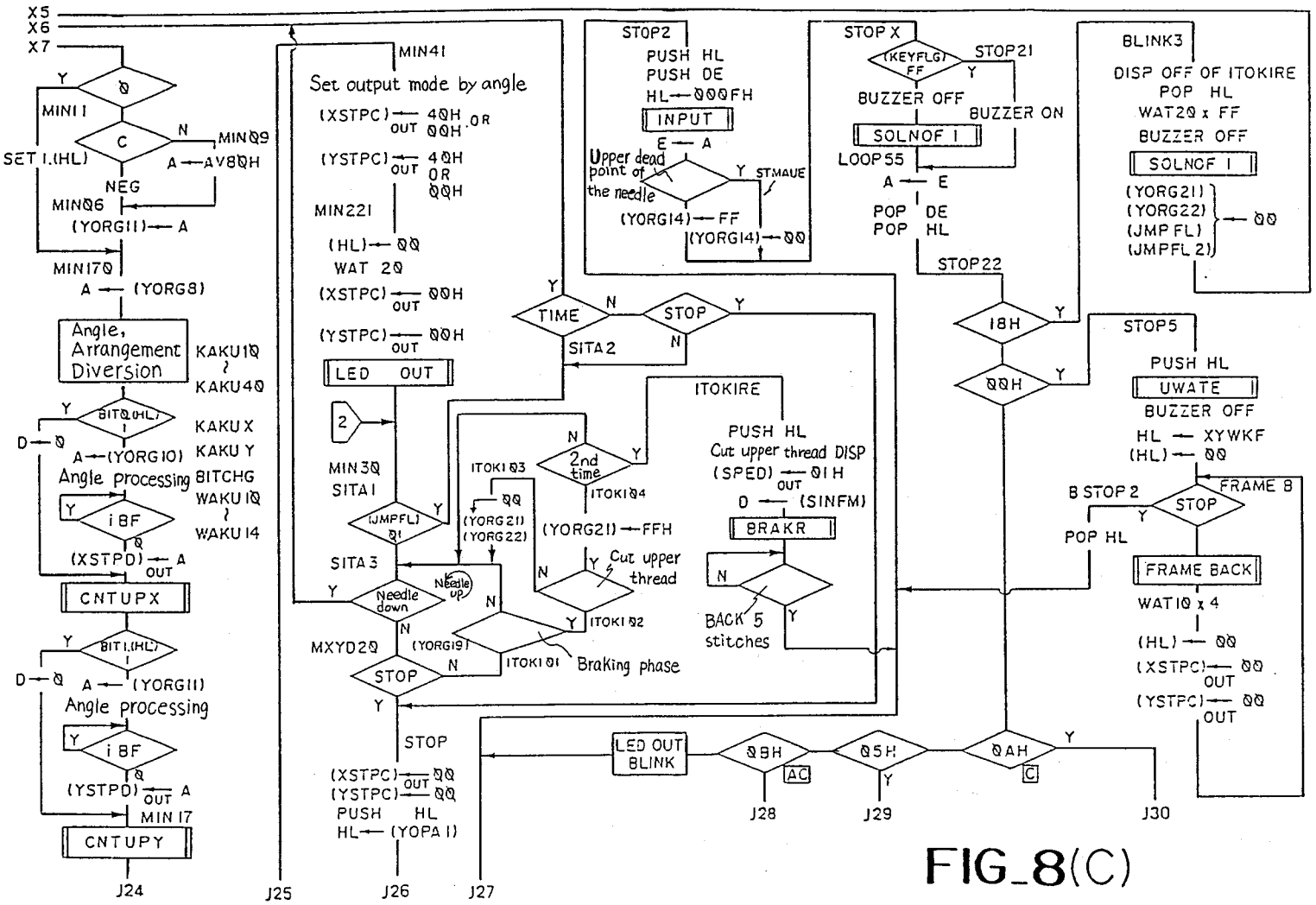
Figure 8D:
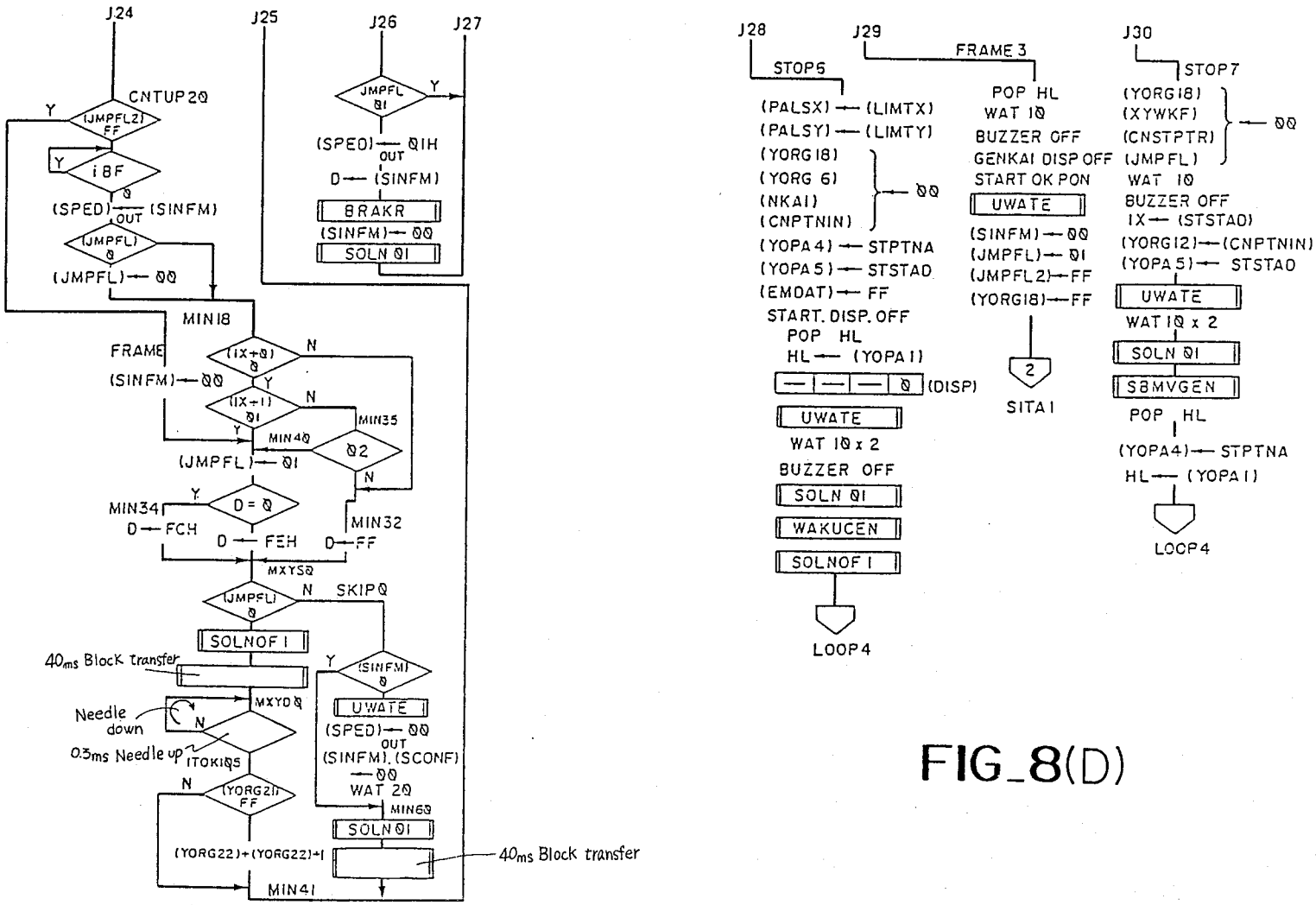
Figure 9:
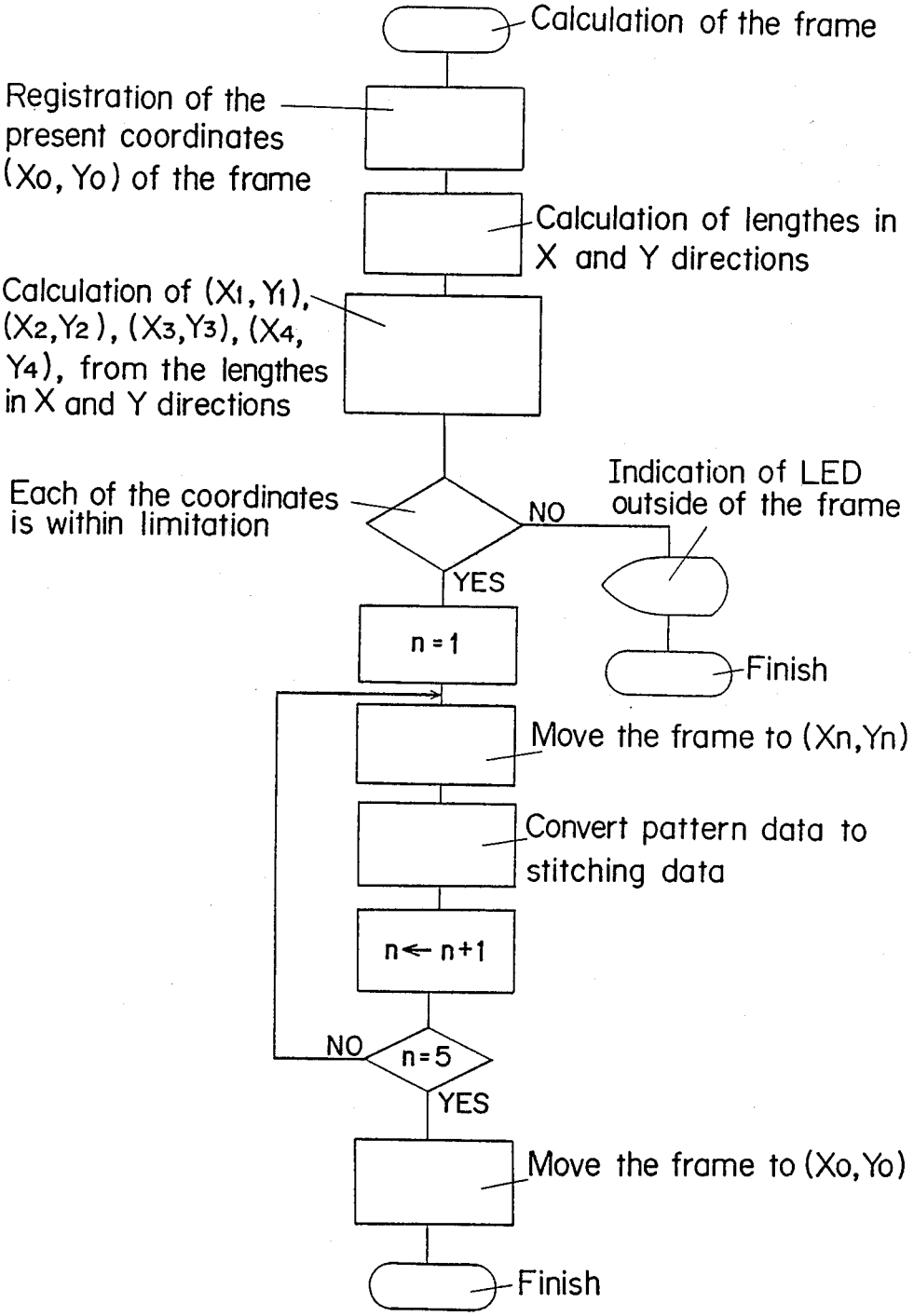

Floppy disc FD of this invention stores, as shown in FIG. 5, the embroidering data (pattern data concerning shapes of the letters), the pattern indicating data, the enlarging and the reducing data on the both sides thereof (each of the sides 0, 1). SE is a sector, and T is a track. FDD is a floppy disc drive, and rotates the floppy disc FD during reading out and writing in the random access memory RAM. FDC is a floppy disc controller connected between the floppy disc drive FDD and the microprocesor CPU. The interface of the floppy disc drive FDD depends from a bus structrue. A control is depending upon a high speed pulse signal or an independent level signal. Thereupon, necessary data are written in an inner register of the floppy disc controller FDC, and when a command is sent, search, read, write and initialization operations are automatically performed.

SVM1 is a slave micro computer for controlling X-shaft, and is 1-chip micro computer housing an interface register which simplifies changing of informations with a program memory, data memory, ALU, I/O port, timer/counter, clock and system data bus. In this invention, the slave program concerning the X-shaft control is run by the slave micro computer SVM1, thereby carrying out the necessary steps of driving in a destined direction in response to the order from the main micro computer, the detection of the initial point of the frame 1, and the positioning thereof. Time rate of controlling speed-up and slow-down of driving the step motor is controlled by the slave computer SVM1.

SVM2 is a slave micro computer for controlling Y-shaft, and its structure, purpose and function are the same as those of the X-shaft controlling slave micro computer SVM1.

SVM3 is a slave micro computer for controlling a machine motor driving the main shaft of the sewing machine, and issues orders of starting, stopping and speed control of the circuit of the machine motor in response to the order from the main microcomputer. The data and the commands are exchanged between the slave micro computers SVM1, SVM2, SVM3 and the main micro computer, observing status bits of the slave micro computers. An address input from the micro processor CPU distinguishes the data or the command. DVX is a driver for driving the X-shaft step motor, and DVY is a driver for the Y-shaft step motor.

SC is a speed control circuit for executing start, stop and speed control of the machine motor M, and comprises a phase control circuit using a thyristor element.

A power source circuit PSC supplies DC constant-voltage to the electronic circuits. The key panel 8 in FIG. 4 forms a key matrix, and each of wires from the matrix is connected to the input-output interface I/O which composes one part of the main micro computer.

DISPLAY 34 is a display part composed of LED 27, LED 29, LED 33 and LCD (liquid crystal indicator), 9 shown in FIG. 3. S1 is a sensor of breaking of the upper thread, and a photo-sensor provided at a spring for catching the thread in the path. Said sensor is provided with a light interrupting piece on said thread catching spring and is provided with a light projecting element and a light receiving element opposite to said interrupting piece. When the upper thread is pulled up by the take-up lever, said spring is pulled up due to the thread tension and the interrupting piece is moved to the interrupting side. Accordingly, when the light interruption is not effected at a rotation phase of the sewing machine where the light is interrupted, then the upper thread would be broken, because the interrupting piece is not displaced since the thread tension is not effected on said thread catching spring. The present system is programmed such that the breaking of the upper thread is detected several times, and said breaking condition is confirmed.

S2 is a sensor of detecting the amount of a lower thread remaining for detecting a less amount than a certain amount of the lower thread. This sensor is provided with a light projecting element and a light receiving element, and recognizes that the remaining amount of the lowere thread is less, when the light comes to the receiving face.

In the present system, an infrared LED is used for the light projecting element. Since the light is projected at relatively high frequency and is amplified at the receiving side, a detection in a relatively long distance is possible.

The light reception is converted to ON-OFF signal, and this signal is connected to LED for notifying the remaining amount of the lower thread on display 33. When the lower thread is less and thus less light is received by the light receiving element, a part of the loop taker mechanism interrupts the light at a certain phase. Therefore, when the lower thread is less than a determined amount during rotation of the sewing machine, said LED repeats on-and-off.

S3 is a sensor of an upper shaft rotating phase for detecting a braking signal output phase and X-Y shaft driving phase. The braking output phase is provided around the upper dead point of a take-up lever, and X-Y shaft driving phase, i.e., the embroidering frame driving phase is set at a phase where the needle is positioned above a fabric.

When a thread loosening solenoid SOL moves the embroidering frame 1 only during stopping of the upper shaft, i.e., during stopping of the needle at the upper dead point of the take-up lever, or when a jump code is present during operating the embroidering stitching, the sewing machine may be stopped temporalily to move the embroidering frame. In such a case, the fabric might be rubbed or the thread broken, because the displacement of the frame is large, and therefore pressure of a thread tension device is released by the solenoid SOL so as to loosen the upper thread tension and smoothly draw the upper thread.

The upper thread is guided to a thread path during the stoppage of the sewing machine at the beginning of the operation. If the thread tension device was tightened, the stitching would be started under a condition that the thread is not kept between the thread tension device. Therefore, the solenoid SOL is attracted so that the thread is kept therebetween without fail.

A digital switch DS changes stitching pitches of the embroidering letters, and switched positions by the operator are encoded and read in the computer.

SM1 is a step motor for the X shaft which is driven stepwise by the pulse from the X shaft driver DVX. SM2 is a step motor for the Y shaft which is driven by the Y shaft driver DVY. S4 is an initial position sensor for the X shaft, and S5 is an initial position sensor for the Y shaft. When supplying the power source and when pressing the all clear key 12, the initial set actuation is made at the upper dead point of the needle, which moves the embroidering frame until the end point of the needle 2 comes to the center of the embroidering frame. At this time, the sensors S4, S5 are utilized. S6 is a speed sensor for detecting the rotation speed of the sewing machine.

FIGS. 6 to 8 are flow charts for exercising each of the functions, actuations and others having been explained above.

FIG. 6 is a flow chart for moving the embroidering frame so as to confirm the embroidering scope and for calculating from the pattern data to the stitching information, and this flow chart pertains to "SBMVMX" of a flow chart of FIG. 8.

Figure 10A:
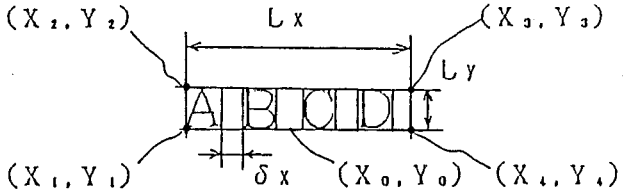
FIGS. 10(A) and (B) are examples of arranging letters embroidered by the machine of this invention.
Figure 10B:
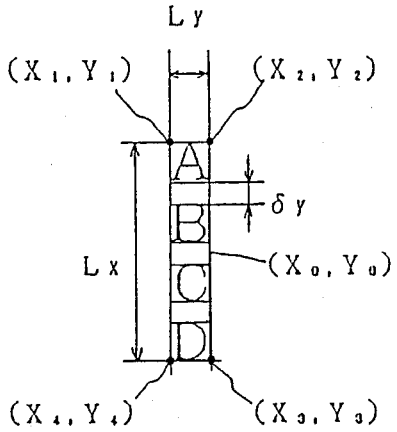

When the program is started, the coordinate (X0, Y0) of the present positions is registered as the position coordinate of the embroidering frame 1 (which will be expressed with the coordinate of the needle 2 dropping points to the embroidering frame 1). Then calculations are made as to the lengths Lx of all the scopes in X direction of a plurality of the patterns of selected letters and the lengths Ly in X direction. From the lengths in X and Y directions, calculations are made as to each of the coordinates (X1, Y1), (X2, Y2), (X3, Y3) and (X4, Y4) of FIGS. 10A and 10B showing the maximum points (apexes) in X and Y directions. If a coordinate exceeds the limit of moving of the frame 1, LED 33 indicates that it is outside of the limit and this the program is finished. When it is within the limit, an affix n is progressed in succession for following calculations, while the frame 1 is moved to the coordinates (Xn, Yn), and the frame 1 is stopped temporalily and a calculation is made for the conversion to the stitching data including calculations of enlargement, standardization and reduction of the pattern with respect to the pattern data of the coordiates (Xn, Yn). When the calculations are finished as to the coordinates (Xn, Xy), the frame 1 is moved according to the coordinates of the present position (X0, Y0) and this program is finished. δx and δy of FIG. 10 are spaces in X and Y directions between the letter patterns, and are set independently in accordance with the combination of the letter patterns.

What is claimed is:

1. An operation initiating system for a computer controlled embroidering machine including means for reciprocating a needle in a vertical plane and a frame arranged in a horizontal plane to hold a fabric to be embroidered, said system comprising means for moving said frame along X and Y coordinates in said horizontal plane; a memory for storing pattern data representing series of stitches pertaining to different patterns to be embroidered; means for selecting desired patterns from said memory; means for controlling said reciprocating means and said moving means, said controlling means including a single start key and an initial stitching position selecting key; said selecting key, when actuated prior to said start key, determining an optional initial position of said frame relative to said needle; said controlling means responding to the first actuation of said start key by moving said frame in the direction of said X and Y coordinates along straight lines enclosing the selected patterns without activating said reciprocating means; and said controlling means further responding to the second actuation of said start key and to the preceding actuation condition of said selecting key by moving said frame into said optional initial position when said selecting key had been actuated, or into a predetermined initial centering position for the selected patterns when said selecting key had not been actuated, and subsequently activating said embroidering machine together with said reciprocating means to start stitching of said selected pattern.

2. The system as defined in claim 1, further comprising means for warning the operator when said straight lines exceed the limit of said frame.

* * * * *